US005545077A

United States Patent [19]

Boeck et al.

[11] Patent Number: 5,545,077

[45] Date of Patent: Aug. 13, 1996

[54] BELT GRINDER WITH A PLATE TENSIONING MEANS

[75] Inventors: Cornelius Boeck, Leinfelden-Echterdingen; Rudolf Fuchs, Neuhausen, both of Germany

[73] Assignee: Robert Bosch GmbH, Stuttgart, Germany

[21] Appl. No.: 381,995

[22] PCT Filed: Aug. 7, 1993

[86] PCT No.: PCT/DE93/00609

§ 371 Date: Feb. 7, 1995

§ 102(e) Date: Feb. 7, 1995

[87] PCT Pub. No.: WO94/03308

PCT Pub. Date: Feb. 17, 1994

[30] Foreign Application Priority Data

Aug. 8, 1992 [DE] Germany ..... 9210599 U

[51] Int. Cl.[6] ..... B24B 21/00

[52] U.S. Cl. ..... 451/311; 451/296; 451/355; 451/297

[58] Field of Search ..... 451/296, 297, 451/311, 355

[56] References Cited

U.S. PATENT DOCUMENTS

| | | | |
|---|---|---|---|
| 2,576,745 | 11/1951 | Auten | 451/311 |
| 4,334,390 | 6/1982 | Sumerau | 451/355 |
| 4,642,943 | 2/1987 | Taylor, Jr. | 451/296 |
| 5,185,963 | 2/1993 | De Brey | 451/355 |

*Primary Examiner*—Bruce M. Kisliuk
*Assistant Examiner*—Eileen P. Morgan
*Attorney, Agent, or Firm*—Michael J. Striker

[57] ABSTRACT

A band sander has a motor housing (2) and a band running case (17) located below the latter, the abrasive band revolving therein. The abrasive band is driven via a belt (17) and belt wheels (14, 16). Because of manufacturing tolerances, it is necessary to be able to adjust the belt tension in a simple manner after the device has already been assembled. This is effected by an insert plate (19) which is inserted into a slot (18) between the motor housing (2) and band running case (7) so as to be displaceable. The insert plate (19) has steps (31 to 33) of varying height which determine the distance between the motor housing (2) and band running case (7) and accordingly determine the belt tension.

8 Claims, 3 Drawing Sheets

BELT GRINDER WITH A PLATE TENSIONING MEANS

BACKGROUND OF THE INVENTION

The invention relates to a belt grinder or band sander. DE 37 15 292 A1 discloses a band sander of this type in which the motor shaft and the driven band roller each support a belt pulley. The distance between the belt pulleys is fixed by design. However, for this reason the tension of the belt tightened over the belt pulleys cannot be adjusted subsequently. Excessive tension in the belt reduces the performance of the band sander and can lead to premature wear at the bearings and belt. Belts with insufficient tension also wear out faster, result in slippage and frequently cause disturbingly loud operating noise.

SUMMARY OF THE INVENTION

Accordingly, it is an object of the present invention to provide a band sander which avoids the disadvantages of the prior art.

In keeping with these objects and with others which will become apparent hereinafter, one feature of the present invention resides, briefly stated, in a band sander having a band running case, an abrasive band revolving in the band running case over band rollers, a motor housing placed on the band running case and connectable with the latter, a belt drive having belt wheels for transmitting a motor torque to one of the band rollers, wherein in accordance with the present invention the band sander has means for adjusting a distance between the belt wheels which determines a tension of the attached belt, and the means act between the motor housing and the band running case and is formed as an insert plate having a longitudinal axis parallel to the belt wheel axis when in operating position, and the plate has steps of varying height along the longitudinal axis.

When the band sander is designed in accordance with the present invention, it has the advantage over the prior art that the belt tension can be adjusted in a simple manner when the device is already assembled. Accordingly, manufacturing tolerances at the motor housing and band running case and at the bearing of the driven shaft and band roller as well as length tolerances in the belt itself can be compensated.

In a particularly advantageous manner, a flat insert plate with steps of varying height is provided in the region of the belt between the motor housing and band running case. The advantage of the steps consists in that the distance between the motor housing and band running case can be varied simply by shifting the insert plate in the direction of the separating joint between the two parts. A handle projection is accessible from the outside in every position and is covered by the cover cap of the belt drive after adjustment.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
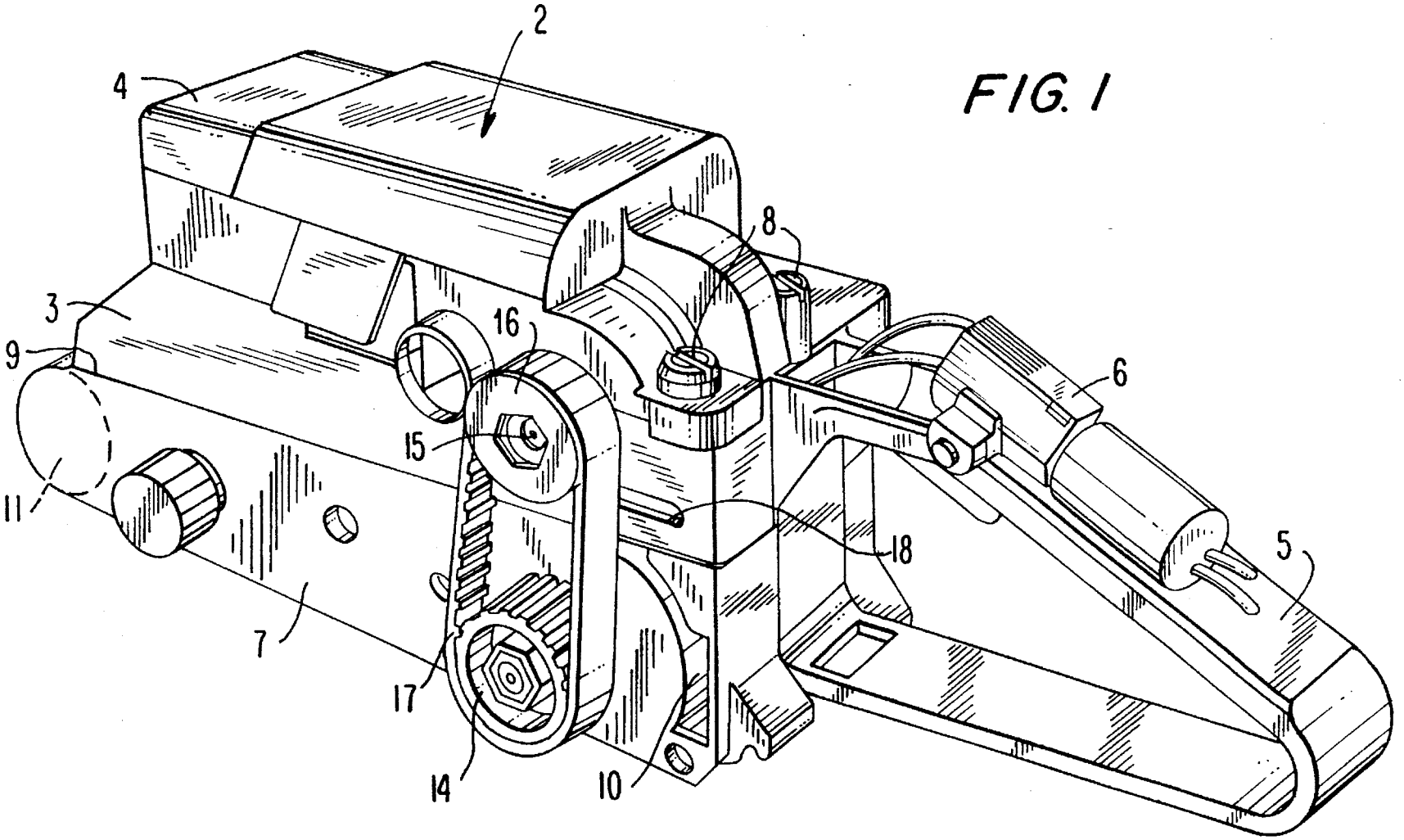
FIG. 1 shows a perspective view.

A hand-operated band sander has a two-part motor housing 2 of plastic with a lower part 3 and an upper part 4, a motor and a gear unit being accommodated therein. A handle 5 with switch 6 is formed integral with the lower part 3. A housing cover covering the switch 6 and a portion of the upper part 4 has been removed and is not shown in FIG. 1. The motor housing 2 is placed upon a band running case 7 of aluminum and is fastened thereto by screws 8. The roughly horizontally extending seam between the motor housing 2 and band running case 7 is designated by 9. An abrasive band guided over two band rollers 10, 11 revolves in the band running case 7. One of the band rollers 10 is connected with a first toothed belt wheel 14 which projects laterally coaxially so as to be fixed with respect to rotation relative to it.

A driven shaft 15 whose end projects laterally and supports a second toothed belt wheel 16 is supported approximately vertically over belt wheel 14 in the motor housing 2 and is driven by the motor 1 via the gear unit. A belt 17, preferably a flat toothed belt, is tensioned over the two belt wheels 14, 16. The belt drive 14, 16, 17 provides for the transmission of motor power to the band roller 10. In the region of the belt drive, the lower part 3 has a lateral slot 18 through which an insert plate 19 of plastic, shown in FIGS. 2 and 3, projects with its actuating handle 20.

Figure 2:
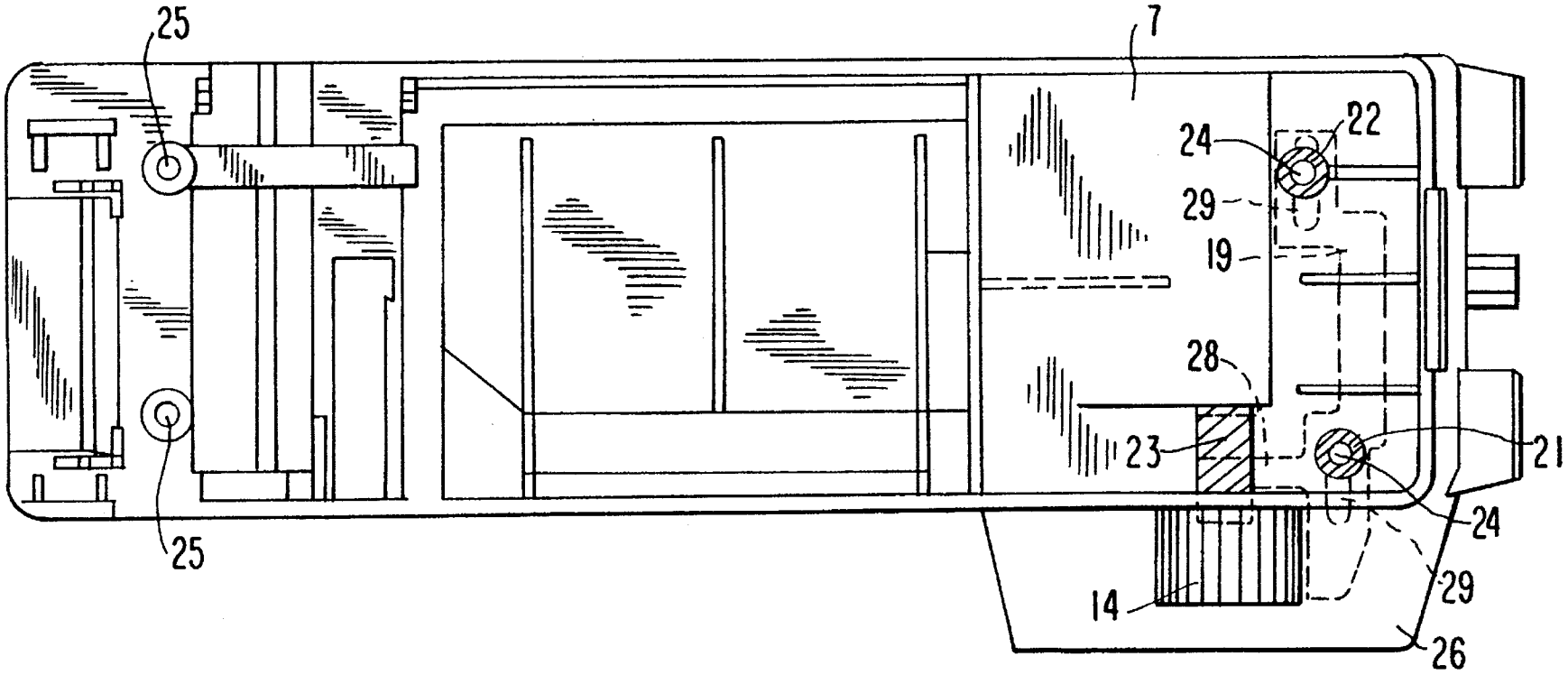
FIG. 2 shows a top view of the band running case with the motor housing removed.
Figure 3:
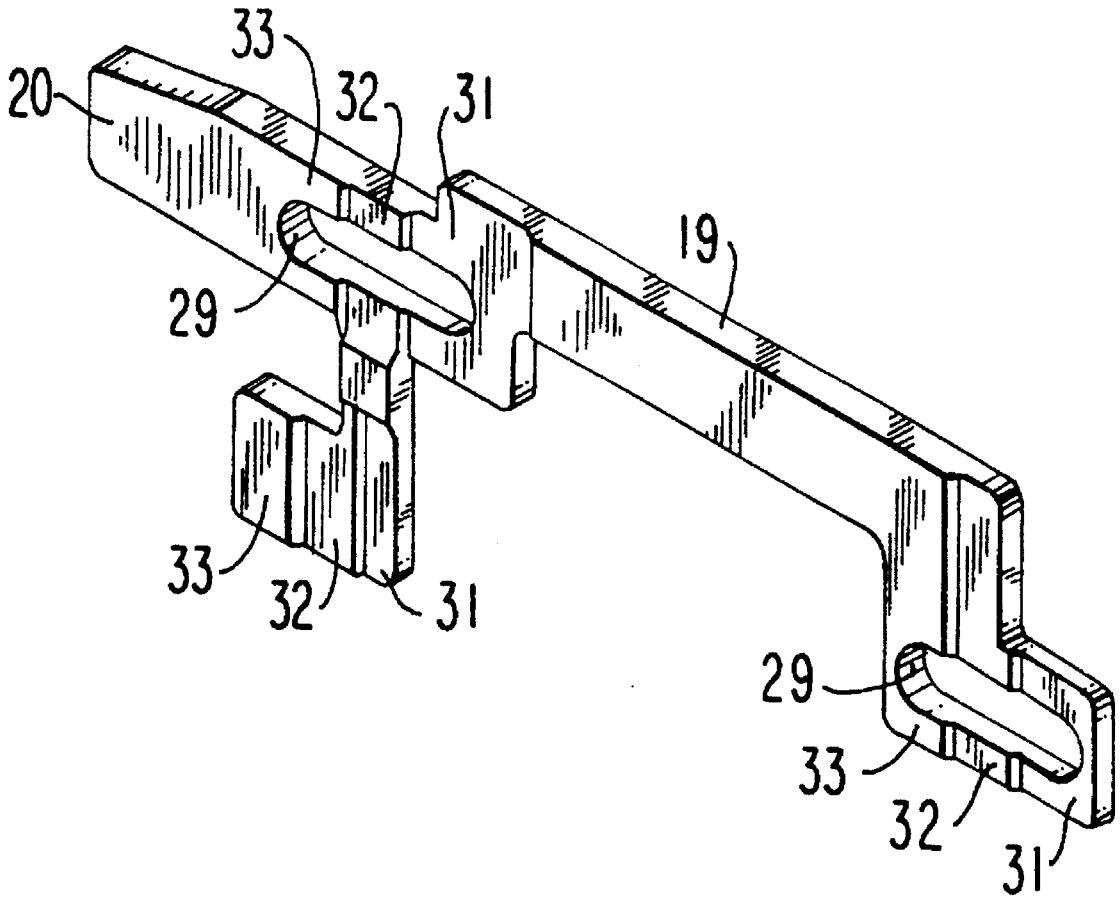
FIG. 3 shows a perspective view of an insert plate.

FIG. 2 shows a top view of the upper side of the band running case 7 facing the lower portion 3. This figure shows three support surfaces 21, 22, 23 for the insert plate 18 which lie in a plane. The support surfaces 21 to 23 are somewhat raised with respect to the seam 9 and thus project somewhat into the motor housing 2. Support surfaces which are not shown in the drawing are likewise arranged in the lower part 3 exactly opposite the support surfaces 21 to 23. Two of the support surfaces 21, 22 form annular surfaces around screw holes 24 for screws 8 in each instance. The third support surface 23 lies in the alignment between the axes of the belt wheels 14, 16. Like the other support surfaces 21, 22, this support surface 23 has only a relatively small dimensioning in the order of magnitude of a square centimeter. In addition to screw holes 24, FIG. 2 shows two additional screw holes 25 which also serve for fastening the band running case 7 to the motor housing 2. Belt wheels 14, 16 and actuating handle 20 are covered by a cover cap 26 during operation.

The insert plate 19 which can be loosely inserted is constructed in an elongated manner and has a lateral arm 28 which reaches to the support surface 23. In the elongated portion, elongated holes 29 are located in the screw holes 24 for insertion of screws 8. Three steps 31, 32, 33 of different height are constructed along the elongated holes 29 so that the thickness of the insert plate 19 takes on three different values differing by roughly 0.2 mm. These steps 31, 32, 33 are arranged at the end of the arm 28. It will be seen from FIG. 3 that the flattest steps 31 lie further away from the actuating handle 20 than the highest steps 33 in each instance.

In FIG. 2, the insert plate 19 is so inserted that the lowest steps 31 contact the support surfaces 21 to 23. In this way, the shortest distance can be set between the motor housing 2 and band running case 7. During final assembly of the band sander, the tightness of the belt 17 is tested before the final tightening of the screws 8 with the motor housing 2 firmly supported on the band running case 7. If the belt 17 can be pressed down too far, the insert plate 19 at the actuating handle 20 is pushed inward by another step. Steps 32 then contact the contact surfaces 21 to 23. If the belt tension is still insufficient, the insert plate 19 can be pushed in again by a further step. In this way, the greatest possible distance is achieved between the belt wheels 14, 16. After setting the correct belt tension, the screws 8 are tightened and the housing top is placed on the upper part 4 and handle 5 so as to cover the screws 8. The cover cap 26 covering the belt drive and actuating handle 20 is then attached to the side. This rules out subsequent unintentional adjustment of the belt tension.

We claim:

1. A band sander, comprising a band running case; band rollers arranged in said band running case and adapted for guiding an abrasive band; a motor housing connected with said band running case; a belt drive including belt wheels having axes of rotation and a belt and transmitting a motor torque to one of said band rollers; means for adjusting a distance between said belt wheels which determines a tension of said belt, said means including an insert plate having a longitudinal axis which is parallel to said axes of rotation of said belt wheels when in operating position, said plate having steps of varying height along said longitudinal axis.

2. A band sander as defined in claim 1, wherein said insert plate is located between said motor housing and said band running case.

3. A band sander as defined in claim 1, wherein said insert plate is displaceable between said motor housing and said band running case.

4. A band sander as defined in claim 1; and further comprising means for connecting said band running case with said motor housing, said connecting means including screws, said insert plate having elongated holes through which said screws pass.

5. A band sander as defined in claim 1, wherein said motor housing and said band running case have oppositely located planar support surfaces located between said axes of rotation of said belt wheels.

6. A band sander as defined in claim 1, wherein said band running case has support surfaces for said motor housing, said steps of said insert plate being supported on said support surfaces.

7. A band sander as defined in claim 1, wherein said insert plate has an actuating handle which projects laterally from said motor housing in a region of said belt drive.

8. A band sander as defined in claim 1, wherein said insert plate has an actuating handle which projects laterally from said band running case in a region of said belt drive.

* * * * *